US008113092B2

(12) United States Patent
Lee

(10) Patent No.: US 8,113,092 B2
(45) Date of Patent: Feb. 14, 2012

(54) PUSH-TYPE RATCHET WRENCH

(75) Inventor: Cheng-Han Lee, Taiping (TW)

(73) Assignee: Re-Dai Precision Tools Co., Ltd., Taiping, Taichung County (TW)

( * ) Notice: Subject to any disclaimer, the term of this patent is extended or adjusted under 35 U.S.C. 154(b) by 340 days.

(21) Appl. No.: 12/590,054

(22) Filed: Nov. 2, 2009

(65) Prior Publication Data

US 2011/0056336 A1 Mar. 10, 2011

(30) Foreign Application Priority Data

Sep. 9, 2009 (TW) ..... 98216604 U

(51) Int. Cl.
*B25B 13/46* (2006.01)

(52) U.S. Cl. ..... 81/63; 81/63.2

(58) Field of Classification Search ..... 81/60–63.2
See application file for complete search history.

(56) References Cited

U.S. PATENT DOCUMENTS 7,237,461 B1 * 7/2007 Wu ..... 81/63.2
7,322,263 B2 * 1/2008 Wu ..... 81/63.2
2004/0011162 A1 * 1/2004 Hsien ..... 81/63.2

* cited by examiner

*Primary Examiner* — David B Thomas
(74) *Attorney, Agent, or Firm* — Charles E. Baxley

(57) ABSTRACT

A push-type ratchet wrench may be easily operated. At least one end of a handle has a head, in which a driving body for rotating a workpiece and an engaging block capable of selectively switching the rotation direction of the driving body are provided. Also, a control member for actuating the engaging block is provided on the head. The control member includes a base disposed in the head, and an actuating block pivotally mounted on the base. The actuating block has an actuating sheet passing through the base and extending toward the engaging block. A clamping slot is formed at a location corresponding to the engaging block so that the actuating sheet can be clamped by the engaging block, and the user can press the actuating block leftward/rightward to achieve the object of switching and to prevent the conventional problems of easily breaking and uneasily actuating.

6 Claims, 7 Drawing Sheets

PUSH-TYPE RATCHET WRENCH

BACKGROUND OF THE INVENTION

1. Field of the Invention

The invention relates to the technological field of switching a driving direction in a ratchet wrench, and more particularly to a push-type ratchet wrench, which can be easily operated and has the precise positioning effect.

2. Description of the Related Art

A ratchet wrench is a hand tool with the unidirectional driving ability, and is mainly used to screw and unscrew a bolt (nut) without the need of continuously changing the hand's posture so that the operation convenience can be obtained. The conventional ratchet wrench has a handle having a head formed with a chamber, in which a driving body with pawls formed on its outer periphery is disposed. The driving body has a fitting hole to be fit with the bolt (nut) or a fitting head to be inserted into a sleeve. The head is formed with an engaging block on a periphery on one side of the driving body in the free space. The engaging block has pawls corresponding to the driving body and is for restricting the engaging direction of the driving body. Furthermore, a control member capable of shifting the engaging block is formed on the head. The control member is typically a rotatable actuating rod, which may be rotated or swung to control the movement of the engaging block.

When these conventional ratchet wrenches are actually used, the positioning effect during operation is poor because the operating direction of the actuating rod and the moving direction of the engaging block are the same. That is, the actuating block is oppositely moved by the engaging block during operation, thereby influencing the operation effectiveness of the ratchet wrench. Furthermore, the size of the engaging block is not large, so the space for accommodating the actuating rod is limited and the size of the actuating rod of the control member is reduced. Thus, the too-small actuating rod causes the inconvenience for the user's operation, thereby influencing the actual operating convenience. More particularly, the control member with the too-small size may be broken due to the improper force applied during the operation process so that the lifetime thereof is shortened.

In view of this, a push-type ratchet wrench is developed to overcome the problems, including the uneasy operation of the ratchet wrench and the poor positioning effect, encountered in the switching operation of the ratchet wrench.

SUMMARY OF THE INVENTION

It is therefore a main object of the invention to provide a push-type ratchet wrench for switching the operating direction by the leftward/rightward pressing without the problems of the easily breaking and the uneasily actuating so that the precision of the motion and the operation convenience can be enhanced.

The invention achieves the above-identified object by providing a push-type ratchet wrench comprising a handle, a driving body, an engaging block and a control member. The handle has two ends. At least one of the two ends has a head. The head is formed with a chamber with an opening on one side of the head. The chamber is composed of a first accommodating slot and a second accommodating slot communicating with each other. The other side of the head opposite to the one side of the head is formed with a long slot opening communicating with the second accommodating slot.

The driving body is disposed in the first accommodating slot of the chamber of the head. A periphery of the driving body is formed with a series of pawls, and the driving body is for embedding and fitting with a workpiece.

The engaging block is disposed on one side of the driving body disposed in the first accommodating slot of the head. An internally curved surface of the engaging block is formed with pawls corresponding to the pawls of the driving body. A middle of a rear edge of the engaging block is formed with a clamping slot. Two sidewall surfaces of the clamping slot are slopped conical surfaces expanding outwards.

The control member is disposed in the second accommodating slot of the chamber of the head. The control member has a base disposed in the second accommodating slot and an actuating block pivotally connected to the base. The base has an inserting slot, in which the actuating block may be inserted and swung. A plurality of positioning slots is formed on a wall surface of the inserting slot. A cross slot, across which the actuating block may be placed, is formed on the base. A lower half section of the actuating block may be placed across the cross slot of the base. An upper half section of the actuating block projects out of the long slot opening of the head. The actuating block has a projecting extension inserting through the inserting slot. A positioning steel ball, which may be elastically moved by an elastic member, is disposed on the actuating block. The actuating block may be restricted relatively to the positioning slot of the base using the positioning steel ball. A hole is formed at an end portion of the projecting extension of the actuating block. An actuating sheet is embedded into the hole. The actuating sheet penetrating through the base is clamped in the clamping slot of the engaging block so that the push-type ratchet wrench that may be conveniently switched and operated is constructed.

The operating direction of the actuating block of the control member of the invention is perpendicular to the moving direction of the engaging block. Thus, the engaging block may be stably limited, no malfunction of the engaging block is caused during operation, and the size of the control member assembly can be enlarged. Thus, the engaging block can be easily operated, and is free from being broken due to the improperly applied force so that the lifetime thereof may be effectively lengthened. Thus, the ratchet wrench of the invention may be improved in the aspects of the precision of the motion, the operation convenience and the lifetime.

Further benefits and advantages of the present invention will become apparent after a careful reading of the detailed description with appropriate reference to the accompanying drawings.

BRIEF DESCRIPTION OF THE DRAWINGS

The above and other objects of the present invention will become readily apparent by reference to the following detailed description when considered in conjunction with the accompanying drawings wherein.

DETAILED DESCRIPTION OF THE INVENTION

Figure 1:
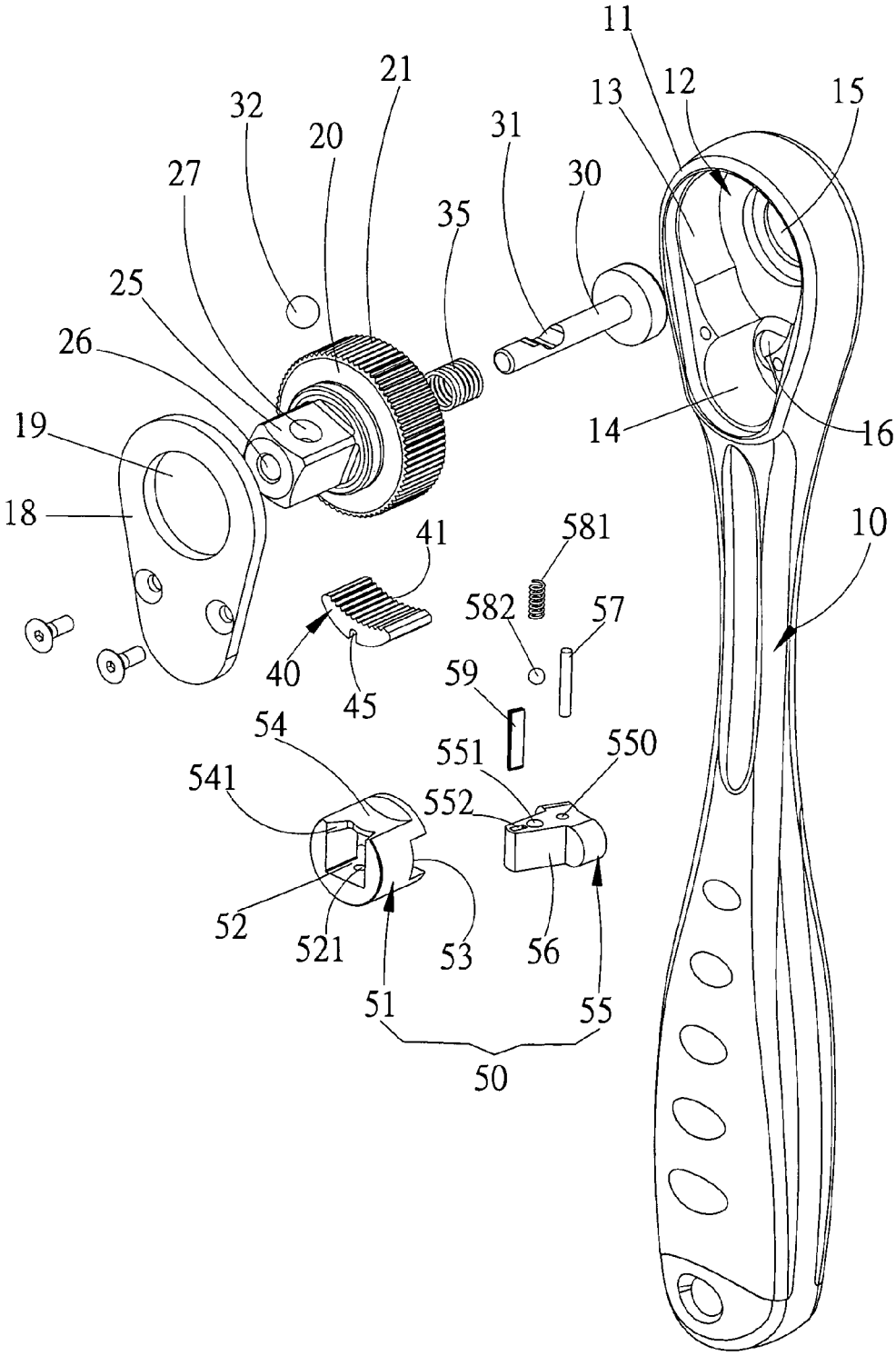
FIG. 1 is a stereoscopic decomposed schematic illustration showing a ratchet wrench of the invention for the description of its components and relative relationships between the components.
Figure 2:
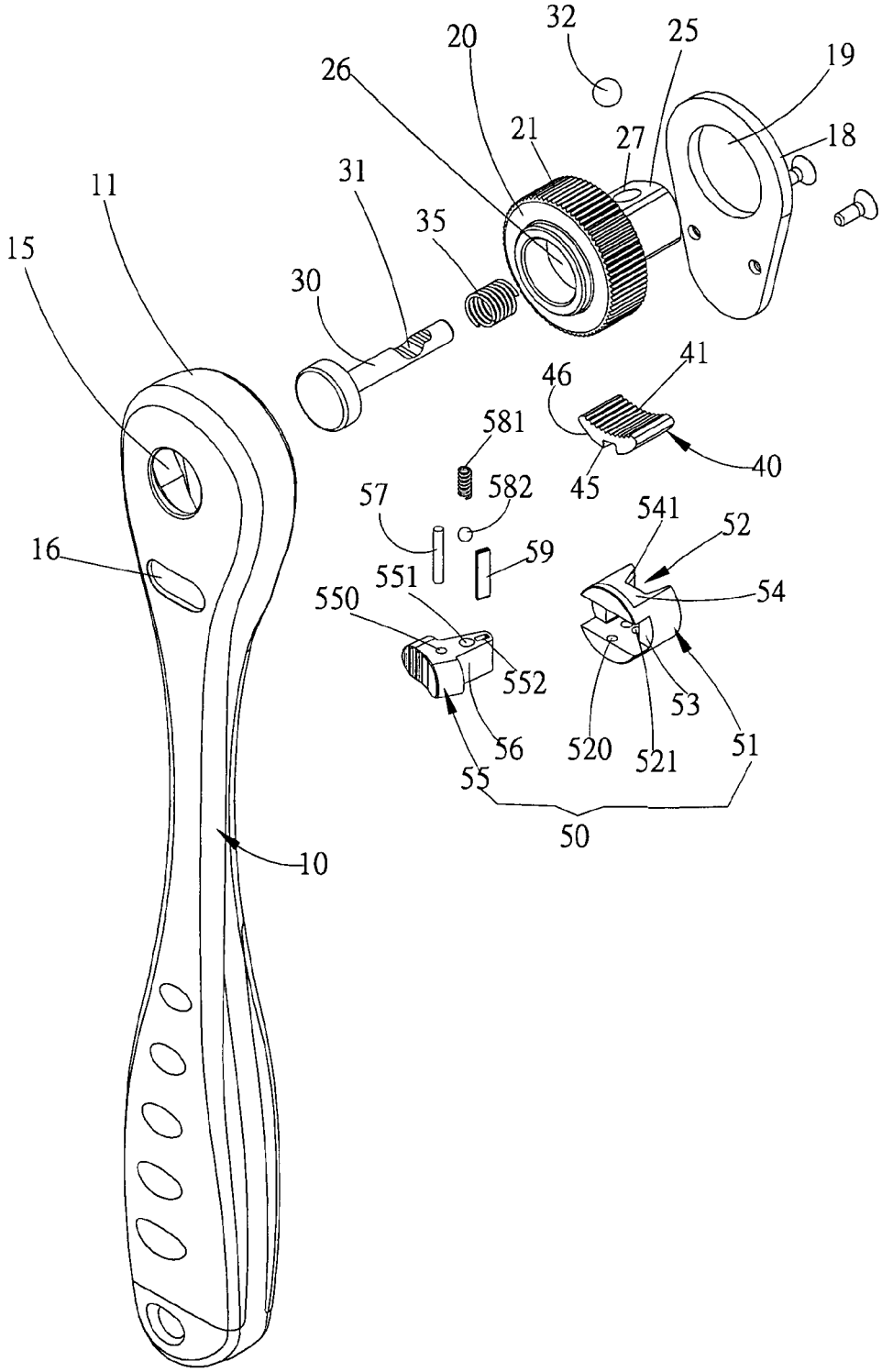
FIG. 2 is a stereoscopic decomposed schematic illustration showing the ratchet wrench of the invention at another viewing angle.

The structure of a ratchet wrench of the invention is shown in FIGS. 1 and 2, and includes a handle 10 having a head 11, a driving body 20 disposed in the head 11, an engaging block 40 for restricting the rotation of the driving body 20, and a control member 50, which can be pressed to control the movement of the engaging block 40.

The detailed structure according to the preferred embodiment of the invention will be described with reference to FIGS. 1, 2 and 4. At least one of two ends of the handle 10 has the head 11. The head 11 is formed with a chamber 12 with an opening toward one side. The chamber 12 is composed of a first accommodating slot 13 and a second accommodating slot 14 communicating with each other. The first accommodating slot 13 with the larger diameter can accommodate the driving body 20 and the engaging block 40, and the second accommodating slot 14 with the smaller diameter can accommodate the control member 50. Also, the other side of the head 11, which is formed with the opening of the chamber 12 and opposite to the one side of the head 11, is formed with a through opening 15 communicating with a center of the first accommodating slot 13, and is formed with a long slot opening 16 communicating with the second accommodating slot 14. Furthermore, a cover sheet 18 for restricting the driving body 20, the engaging block 40 and the control member 50 is screwed to the one side of the head 11 formed with the opening of the chamber 12. The cover sheet 18 is formed with a through hole 19 corresponding to the center of the driving body 20.

A periphery of the driving body 20 disposed in the chamber 12 of the head 11 is formed with a series of pawls 21 to be meshed with the engaging block 40. Also, the center of the driving body 20 has a fitting hole for embedding and fitting with a bolt (nut), or a polygonal rod-like fitting head 25 for inserting into a sleeve in the main embodiment of the invention. The fitting head 25 may penetrate through the through hole 19 of the cover sheet 18 screwed to the head 11. Also, a slide hole 26 is formed on an axis of the fitting head 25, and a side surface of the fitting head 25 is formed with an engagement hole 27 perpendicularly communicating with the slide hole 26. An actuating rod 30 is disposed in the slide hole 26 and may slide therein. One end of the actuating rod 30 may penetrate through the through opening 15 of the head 11 of the handle 10. Also, the actuating rod 30 is formed with a stepped slot 31 corresponding to the engagement hole 27 of the fitting head 25. Moreover, a steel ball 32 capable of selectively partially projecting out of the engagement hole 27 is disposed in the stepped slot 31. In addition, an elastic member 35 is disposed between the actuating rod 30 and the slide hole 26 of the fitting head 25 so that the user can press the actuating rod 30 to move outward to operate the actuating rod 30 to selectively move the steel ball 32 to force on the fitting head 25 (not shown) relatively to the embedding and fitting sleeve.

Figure 3A:
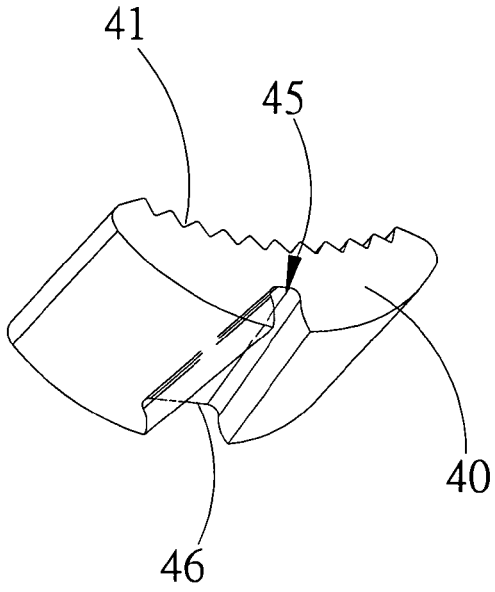
FIG. 3A is a stereoscopic exterior schematic rear view showing an engaging block in the ratchet wrench of the invention.
Figure 3B:
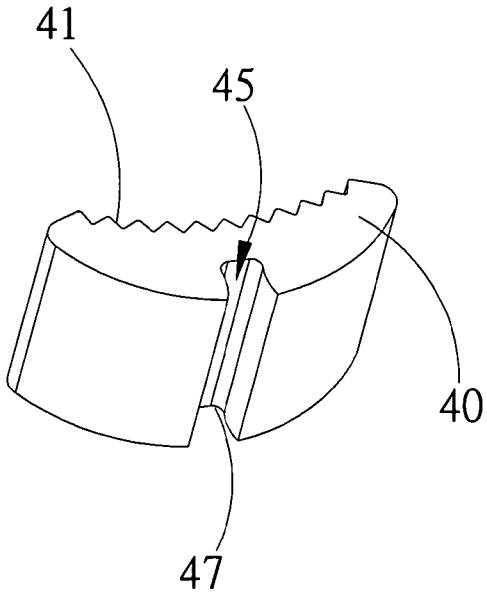
FIG. 3B is a stereoscopic exterior schematic rear view showing an engaging block in the ratchet wrench according to another embodiment of the invention.

The engaging block 40 is a semilunar arc body. An internally curved surface of the engaging block 40 is formed with pawls 41 corresponding to the pawls 21 of the driving body 20 so that the position restricting effect between the engaging block 40 and the driving body 20 may be achieved. Furthermore, the middle of the rear edge of the engaging block 40 is formed with a clamping slot 45. Two sidewall surfaces of the clamping slot 45 may be slopped conical surfaces 46 expanding outwards, as shown in FIG. 3A, or flat straight surfaces 47, as shown in FIG. 3B, so that the control member 50 can be embedded and engaged with the engaging block 40.

The control member 50 is composed of a base 51 and an actuating block 55. The base 51 may be disposed in the second accommodating slot 14 of the head 11 of the handle 10, and has an inserting slot 52, in which the actuating block 55 may be inserted and swung. Also, an upper section of a wall surface of the inserting slot 52 of the base 51 is formed with a shaft hole 520, on which the actuating block 55 is pivotally mounted. Furthermore, positioning slots 521 for positioning the actuating block 55, which has been pressed leftward or rightward, are formed on the wall surface of the inserting slot 52 and below the shaft hole 520. In addition, a cross slot 53, across which the actuating block 55 may be placed, is formed on the base 51, and the periphery of the base 51 is formed with an arced surface 54. The rear edge of the engaging block 40 may rest against the arced surface 54. The lower half section of the arced surface 54 of the base 51 is formed with a communicating hole 541 communicating with the inserting slot 52. The lower half section of the actuating block 55 may be placed across the cross slot 53 of the base 51. The upper half section of the actuating block 55 projects out of the long slot opening 16 of the head 11 so that the upper half section of the actuating block 55 can be pressed leftward or rightward by the user. Furthermore, the actuating block 55 has a projecting extension 56 inserting through the inserting slot 52 of the base 51. Also, a shaft hole 550 corresponding to the shaft hole 520 of the inserting slot 52 is formed on the actuating block 55 such that the actuating block 55 may be pivotally connected to the base 51 through a shaft rod 57. The actuating block 55 is formed with an accommodating hole 551 corresponding to the positioning slot 521 of the base 51. An elastic member 581 and a positioning steel ball 582 are disposed in the accommodating hole 551. Thus, the actuating block 55 may be restricted relatively to the positioning slot 521 of the base 51 using the positioning steel ball 582 that may be elastically moved. Furthermore, the end portion of the projecting extension 56 of the actuating block 55 is formed with a hole 552. An actuating sheet 59 is embedded into the hole 552. The actuating sheet 59 penetrating through the communicating hole 541 of the base 51 is clamped in the clamping slot 45 of the engaging block 40 so that the actuating block 55 can move the engaging block 40 to restrict the rotation direction of the driving body 20. Thus, a push-type ratchet wrench which may be precisely positioned and conveniently switched and operated may be constructed.

According to the structural design of the invention, the invention may be applied to the actual condition. As shown in FIGS. 2, 4 and 5A, when the driving body 20 of the ratchet wrench has to be operated to achieve the operations of clamping in the clockwise direction (direction A) and rotating in the counterclockwise direction (direction B), the left side of the actuating block 55 of the control member 50 is pressed down so that the projecting extension 56 of the actuating block 55 is swung toward the other side, as shown in the operations of FIGS. 5A to 5C. Thus, the actuating sheet 59 of the actuating block 55 can move the engaging block 40 to the same side so that the engaging block 40 can press the driving body 20 and the bolt or sleeve may be driven reversely. Oppositely, the ratchet wrench may be returned by way of free running in the forward direction so that the ratchet wrench can drive the bolt or sleeve reversely in the next cycle.

Figure 4:
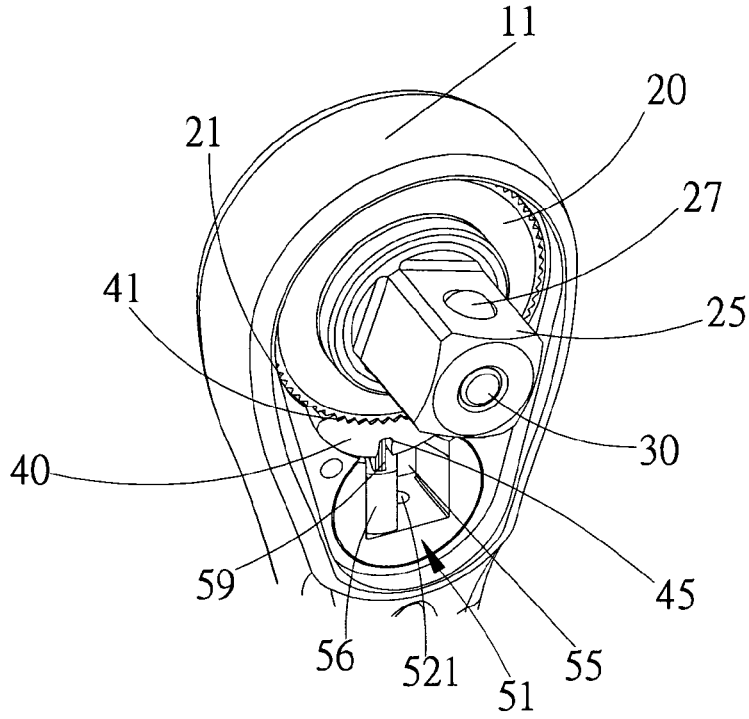
FIG. 4 is a stereoscopic exterior schematic bottom view showing the ratchet wrench in a state when a head is not covered by a cover sheet.
Figure 5A:
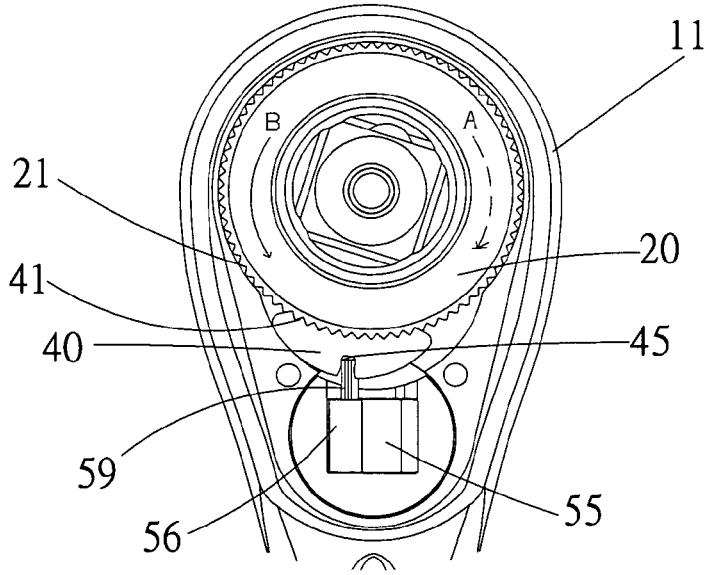
FIG. 5A is a schematic illustration showing the plane motion of the ratchet wrench of the invention, wherein a driving body is in a counterclockwise free running and forward driving state.
Figure 5B:
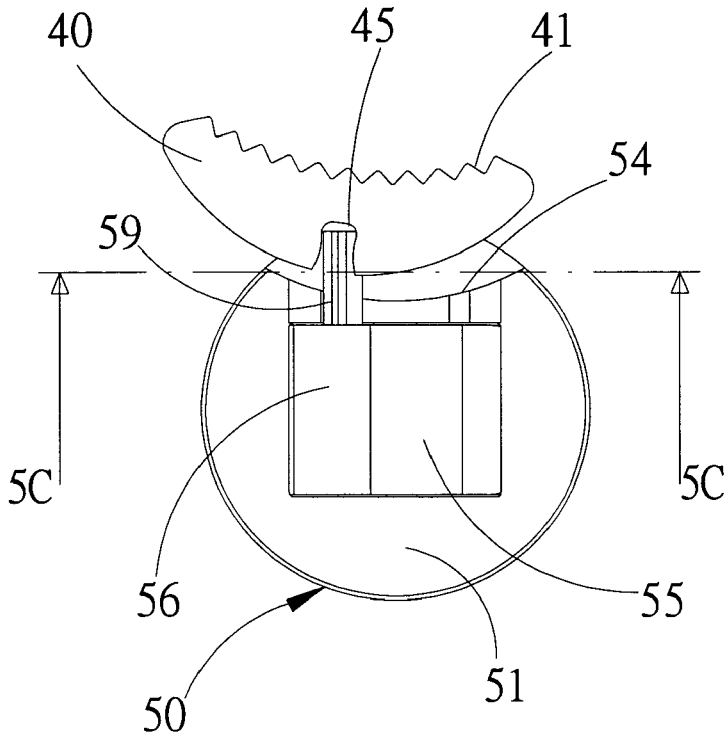
FIG. 5B is a schematic local plane view showing the ratchet wrench of the invention for the description of the relationship between the control member and the engaging block in FIG. 5A.
Figure 5C:
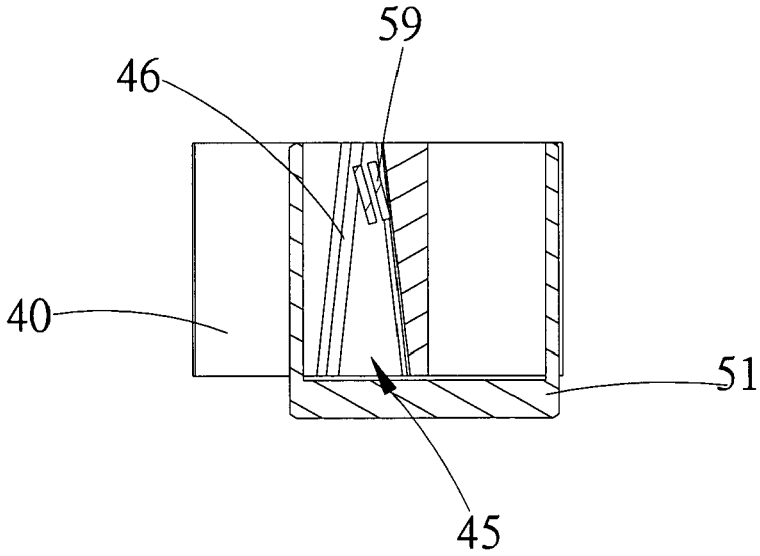
FIG. 5C is a schematically partial cross-sectional view showing the ratchet wrench of the invention for the description of the cross-sectional state taken along 5C-5C of FIG. 5B.
Figure 6A:
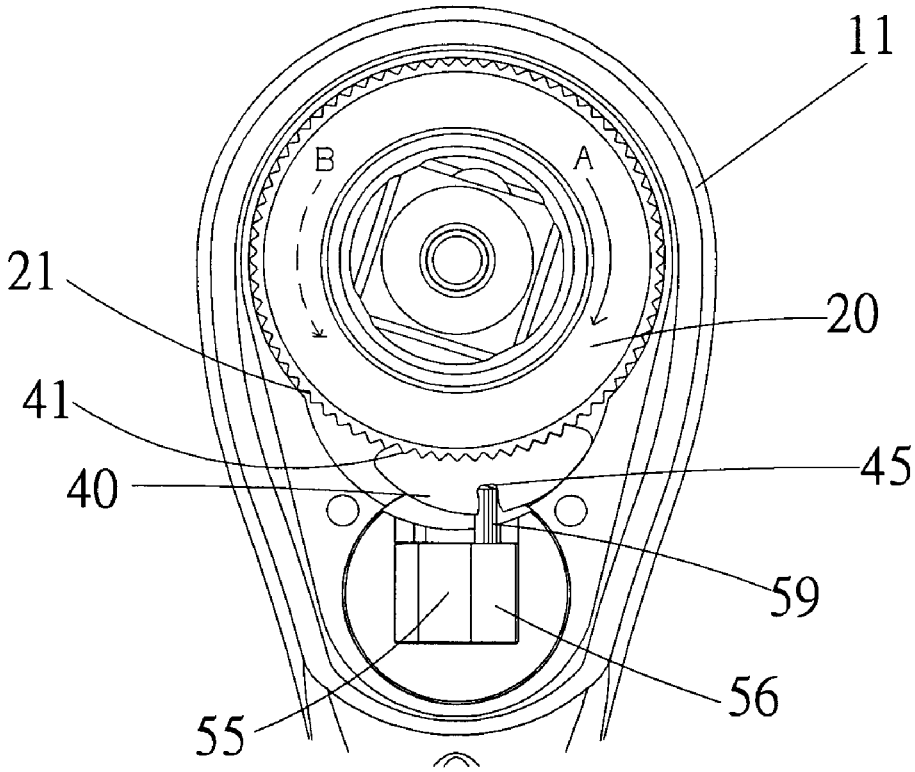
FIG. 6A is another schematic illustration showing the plane motion of the ratchet wrench of the invention, wherein the driving body is in a clockwise free running and reverse driving state.
Figure 6B:
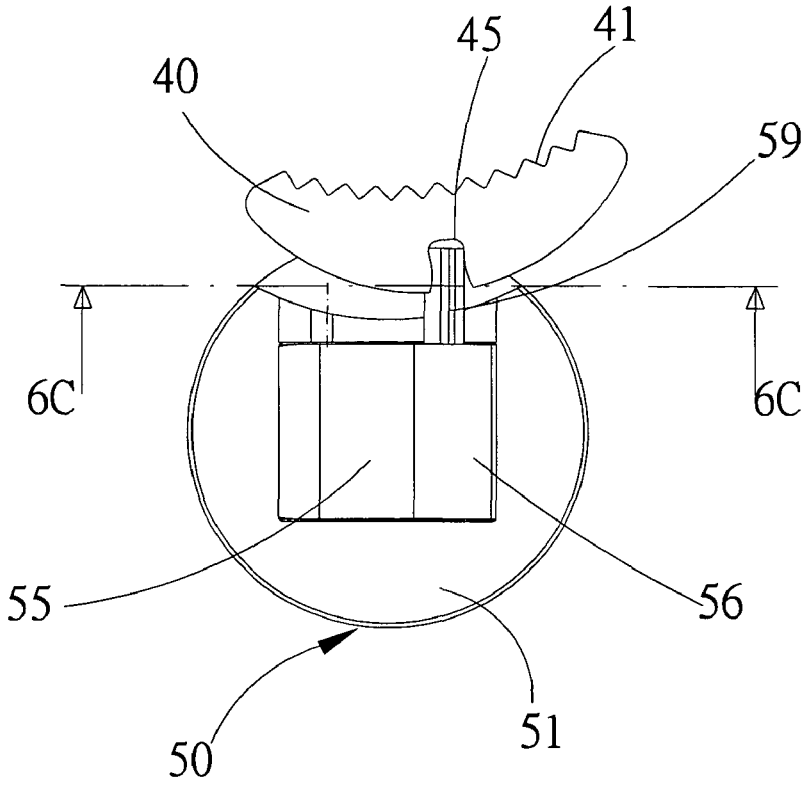
FIG. 6B is a schematic local plane view showing the ratchet wrench of the invention for the description of the relationship between the control member and the engaging block in FIG. 6A.
Figure 6C:
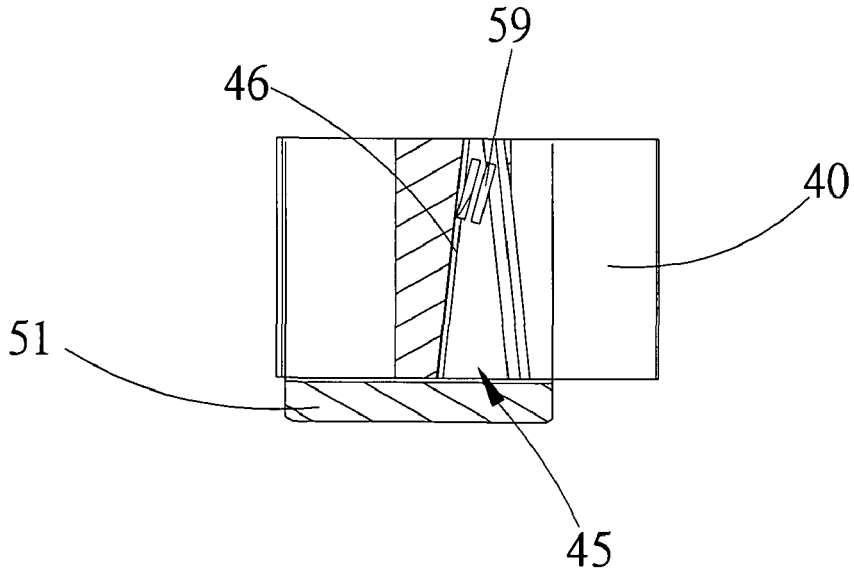
FIG. 6C is a schematically partial cross-sectional view showing the ratchet wrench of the invention for the description of the cross-sectional state taken along 6C-6C of FIG. 6B.

As shown in FIGS. 2, 4 and 6A, when the driving body 20 of the ratchet wrench has to be operated to achieve the operations of clamping in the counterclockwise direction (direction B) and rotating in the clockwise direction (direction A), the right side of the actuating block 55 of the control member 50 is pressed down so that the projecting extension 56 of the actuating block 55 is swung toward the other side, as shown in the operations of FIGS. 6A to 6C. Thus, the actuating sheet 59 of the actuating block 55 can move the engaging block 40 to the same side so that the engaging block 40 can press the driving body 20 and the bolt or sleeve may be driven forward. Oppositely, the ratchet wrench may be returned by way of free running in the reverse direction so that the ratchet wrench can drive the bolt or sleeve forward in the next cycle.

The structure of the invention includes the following improvements.

First, the highly precise movement is obtained. When the ratchet wrench of the invention is actually used, the actuating block 55 of the control member 50 is pressed downward to achieve the object of changing the position of the engaging block 40. Thus, the clamping direction and the free-running direction of the driving body 20 can be further controlled. Because the operation direction of the control member 50 is perpendicular to the moving direction of the engaging block 40, the positioning effect is extremely good during the operation process, and the problem of the malfunction of the engaging block 40 during the operation process cannot occur. Thus, the operation precision of the ratchet wrench is greatly enhanced.

Second, the lifetime is lengthened. Because the operating direction of the control member 50 is vertical, the accommodating chamber is larger, so the assembly can be enlarged to reduce the breaking phenomenon caused by the improperly applied force during the operation process and thus to effectively lengthen its lifetime.

Third, the switching operation may be easily achieved. Because the size of the actuating block 55 is large and the positioning effect is extremely precise, the operation area of the user is large, and the operation convenience can be greatly enhanced.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A push-type ratchet wrench, comprising:

a handle having two ends, wherein at least one of the two ends has a head, the head is formed with a chamber with an opening on one side of the head, the chamber is composed of a first accommodating slot and a second accommodating slot communicating with each other, and the other side of the head opposite to the one side of the head is formed with a long slot opening communicating with the second accommodating slot;

a driving body disposed in the first accommodating slot of the chamber of the head, wherein a periphery of the driving body is formed with a series of pawls, and the driving body is for embedding and fitting with a workpiece;

an engaging block disposed on one side of the driving body disposed in the first accommodating slot of the head, wherein an internally curved surface of the engaging block is formed with pawls corresponding to the pawls of the driving body, a middle of a rear edge of the engaging block is formed with a clamping slot, and two sidewall surfaces of the clamping slot are slopped conical surfaces expanding outwards; and a control member disposed in the second accommodating slot of the chamber of the head, wherein the control member has a base disposed in the second accommodating slot and an actuating block pivotally connected to the base, wherein the base has an inserting slot, in which the actuating block may be inserted and swung, a plurality of positioning slots is formed on a wall surface of the inserting slot, a cross slot, across which the actuating block may be placed, is formed on the base, a lower half section of the actuating block may be placed across the cross slot of the base, an upper half section of the actuating block projects out of the long slot opening of the head, the actuating block has a projecting extension inserting through the inserting slot, a positioning steel ball, which may be elastically moved by an elastic member, is disposed on the actuating block, the actuating block may be restricted relatively to the positioning slot of the base using the positioning steel ball, a hole is formed at an end portion of the projecting extension of the actuating block, an actuating sheet is embedded into the hole, and the actuating sheet penetrating through the base is clamped in the clamping slot of the engaging block so that the push-type ratchet wrench that may be conveniently switched and operated is constructed.

2. The ratchet wrench according to claim 1, wherein a cover sheet for restricting the driving body, the engaging block and the control member is screwed to the one side of the head of the handle formed with the opening of the chamber.

3. The ratchet wrench according to claim 1, wherein the driving body has a fitting head, which penetrates through a cover sheet of the head, for fitting with the workpiece, a slide hole is formed on an axis of the fitting head, an engagement hole perpendicularly communicating with the slide hole is formed on a side surface of the fitting head, an actuating rod is disposed in the slide hole and may slide in the slide hole, the actuating rod is formed with a stepped slot corresponding to the engagement hole of the fitting head, a steel ball capable of selectively partially projecting out of the engagement hole is disposed in the stepped slot, an elastic member is disposed between the actuating rod and the slide hole, and a corresponding through opening is formed on the other side of the head of the handle so that a user presses the actuating rod from the outside to selectively force the steel ball on the fitting head relatively to an embedding and fitting sleeve.

4. The ratchet wrench according to claim 1, wherein a shaft hole is formed on an upper section of a wall surface of the inserting slot of the base of the control member, and a shaft hole corresponding to the shaft hole of the base is formed on the actuating block so that the actuating block is pivotally mounted on the base using a shaft rod.

5. The ratchet wrench according to claim 1, wherein a periphery of the base of the control member is formed with an arced surface corresponding to the engaging block, a lower half section of the arced surface is formed with a communicating hole communicating with the inserting slot, and the actuating sheet of the actuating block penetrating through the communicating hole of the base is clamped in the clamping slot of the engaging block.

6. The ratchet wrench according to claim 1, wherein the actuating block of the control member is formed with an accommodating hole corresponding to the positioning slot of the base, and the accommodating hole accommodates the elastic member and the positioning steel ball.

* * * * *